US007465260B2

(12) United States Patent
Hockemeyer

(10) Patent No.: US 7,465,260 B2
(45) **Date of Patent: *Dec. 16, 2008**

(54) WEIGHTLIFTING BENCH WITH SYNCHRONIZED BACKREST AND SEAT

(75) Inventor: Timothy John Hockemeyer, Midland, MI (US)

(73) Assignee: Rogers Athletic Company, Clare, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/326,059

(22) Filed: Jan. 5, 2006

(65) Prior Publication Data

US 2007/0155604 A1 Jul. 5, 2007

(51) Int. Cl.
*A63B 26/00* (2006.01)

(52) U.S. Cl. ..... 482/142; 482/140

(58) Field of Classification Search ..... 482/142, 482/92–102, 140, 148
See application file for complete search history.

(56) References Cited

U.S. PATENT DOCUMENTS

| | | | | |
|---|---|---|---|---|
| 4,861,024 | A | 8/1989 | Lee | |
| 5,215,510 | A | 6/1993 | Baran | |
| 5,499,962 | A * | 3/1996 | Jones | 482/137 |
| 5,669,859 | A | 9/1997 | Liggett et al. | |
| D444,827 | S | 7/2001 | Mobley | |
| 6,287,243 | B1 * | 9/2001 | Isom et al. | 482/142 |
| 6,605,023 | B1 * | 8/2003 | Mobley | 482/142 |
| 6,623,407 | B2 | 9/2003 | Novak et al. | |
| 6,623,409 | B1 | 9/2003 | Abelbeck | |
| 6,645,130 | B2 * | 11/2003 | Webber | 482/142 |
| 6,659,923 | B2 * | 12/2003 | Teuscher | 482/142 |
| 6,669,607 | B2 | 12/2003 | Slawinski et al. | |
| 6,805,409 | B2 * | 10/2004 | Parker | 297/377 |
| 6,966,872 | B2 * | 11/2005 | Eschenbach | 482/142 |
| 2005/0148449 | A1 * | 7/2005 | Weir et al. | 482/142 |
| 2006/0035772 | A1 * | 2/2006 | Golesh et al. | 482/142 |
| 2006/0040810 | A1 * | 2/2006 | Chu | 482/142 |

* cited by examiner

*Primary Examiner*—Lori Amerson
(74) *Attorney, Agent, or Firm*—Carlson, Gaskey & Olds PC

(57) ABSTRACT

A weight bench system an adjustable seat assembly and an adjustable backrest assembly linkage which assures that a seat cushion frame remains in a comfortable position relative to a backrest cushion frame at all back angle positions. A backrest adjustment pin assembly provides for adjustment of the backrest assembly and the seat assembly. The backrest adjustment pin assembly may be operated either by directly retracting a lock pin or remotely by actuating a remote handle assembly.

19 Claims, 13 Drawing Sheets

WEIGHTLIFTING BENCH WITH SYNCHRONIZED BACKREST AND SEAT

BACKGROUND OF THE INVENTION

The present invention relates to weightlifting equipment, and more particularly to a weight bench which provides one-handed operation for the synchronized movement of backrest to seat articulation.

Weightlifters perform various exercises for the purpose of developing particular muscles throughout the body. These exercises can be performed through the use of free weights, such as barbells, or with machines. Many weightlifters prefer free weights because free weights permit the lifter to perform the exercises in a natural motion while utilizing pure body leverage in performing the exercise. This facilitates isolation of particular muscle groups and simulates actual athletic sports motions.

Oftentimes when utilizing free weights in combination with a weight bench, the backrest and the seat of the weight bench are articulated to perform particular exercises. The backrest of a conventional weight bench typically pivots about a single pivot axis adjacent the seat. Such articulation may often result in a relationship between the backrest and seat which may improperly position the weightlifter. Although, the seat in conventional weight benches is oftentimes separately adjustable, the relationship between the backrest and seat are still relatively limited.

Furthermore, conventional weight benches utilize a separate spring loaded lock pin for each of the backrest and the seat. Although effective and of significant strength, conventional weight bench lock pins are typically situated in relatively difficult to access areas on the weight bench. The combination of difficult to access lock pins with the limited adjustability of the backrest relative to the seat may oftentimes result in a less than desirable exercise experience.

Accordingly, it is desirable to provide a weight bench which provides a more proper relationship between the weight bench backrest and seat with more convenient adjustment thereof.

SUMMARY OF THE INVENTION

A weight bench system according to the present invention includes an adjustable seat assembly and an adjustable backrest assembly which provide synchronized movement therebetween. The adjustable seat assembly and the adjustable backrest assembly linkage assures that a seat cushion frame remains in a comfortable position relative to a backrest cushion frame at all backrest angle positions.

A forward seat link is pivotally mounted to an intermediate seat link at a seat pivot axis, the seat pivot axis transits first forward until an approximately thirty degree position then reverse aft toward the seat cushion frame for the remainder of the backrest cushion frame movement. Such movement provides a proper relationship between the adjustable seat assembly and an adjustable backrest assembly.

A backrest adjustment pin assembly provides for adjustment of the weight bench system. The backrest adjustment pin assembly may be operated either by directly retracting a lock pin or may be operated remotely through a remote handle assembly.

The present invention therefore desirable to provide a weight bench which provides a more proper relationship between the weight bench backrest and seat with more convenient adjustment thereof.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1A:
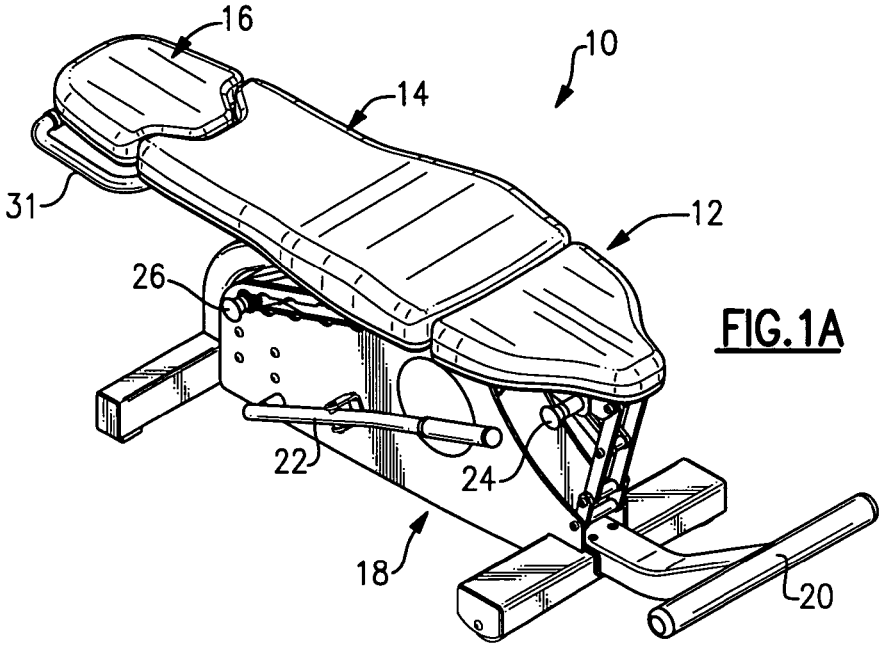
FIG. 1A is a perspective view of the weight bench system.
Figure 1C:
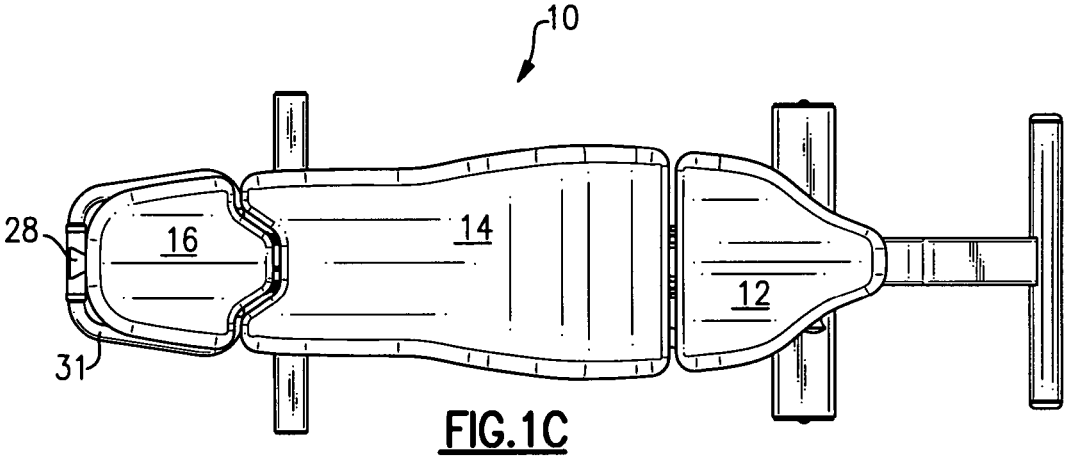
FIG. 1C is a top view of the weight bench system.
Figure 1B:
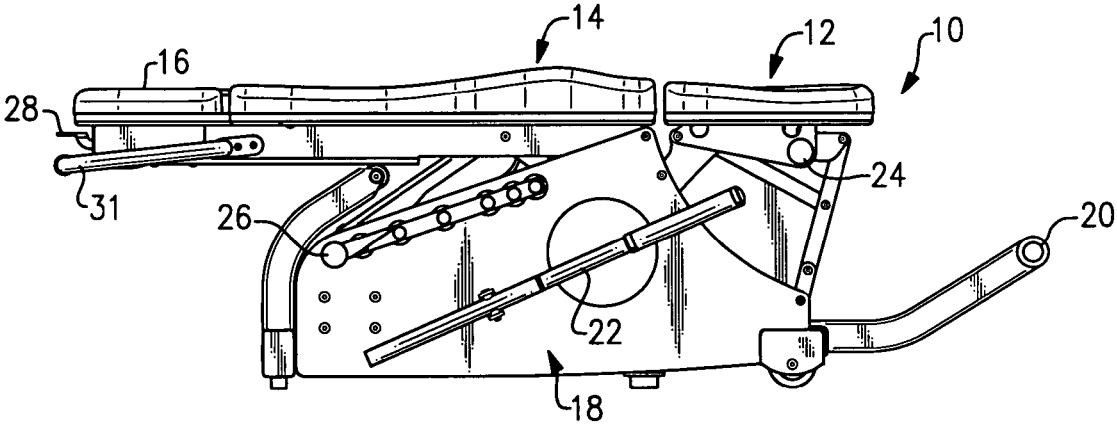
FIG. 1B is a side view of the weight bench system.

FIGS. 1A-1C illustrate views of a weight bench system 10 with a separately adjustable seat assembly 12, an adjustable backrest assembly 14 and an adjustable headrest assembly 16. The seat assembly 12, backrest assembly 14 and headrest assembly 16 are mounted to a frame assembly 18 that may include a foot rest 20.

A fore/aft lever assembly 22, a seat adjustment pin assembly 24, and a backrest adjustment pin assembly 26 provides for significant adjustment of the weight bench system 10. Preferably, a remote handle assembly 28 (illustrated in FIGS. 1B and 1C) adjacent a handle bar 31 on the backrest assembly 14 provides for remote one-hand operation of the backrest adjustment pin assembly 26 such that the backrest assembly 14 may be articulated with one hand from an advantageously accessible position behind the weight bench system 10.

Figure 2A:
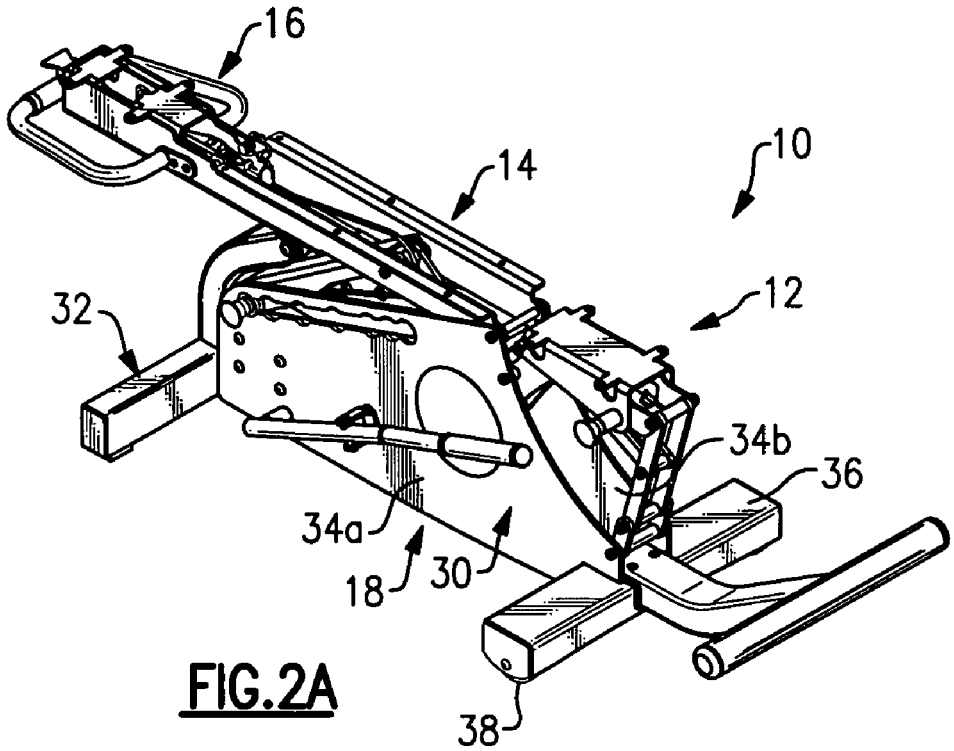
FIG. 2A is a perspective view of the weight bench system with the cushions removed.
Figure 2B:
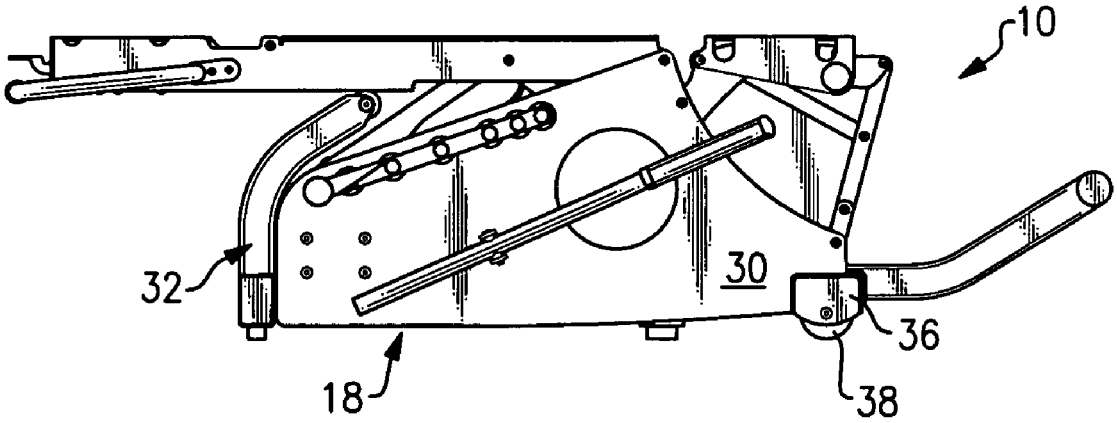
FIG. 2B is a side view of the weight bench system with the cushions removed.

Referring to FIGS. 2A and 2B, the frame assembly 18 includes a base assembly 30 and a rear leg assembly 32. The base assembly 30 includes a first frame plate 34*a*, a second frame plate 34*b* and a transverse front leg 36. The transverse front leg 36 preferably includes rollers 38 to facilitate movement of the weight bench system 10.

Figure 3:
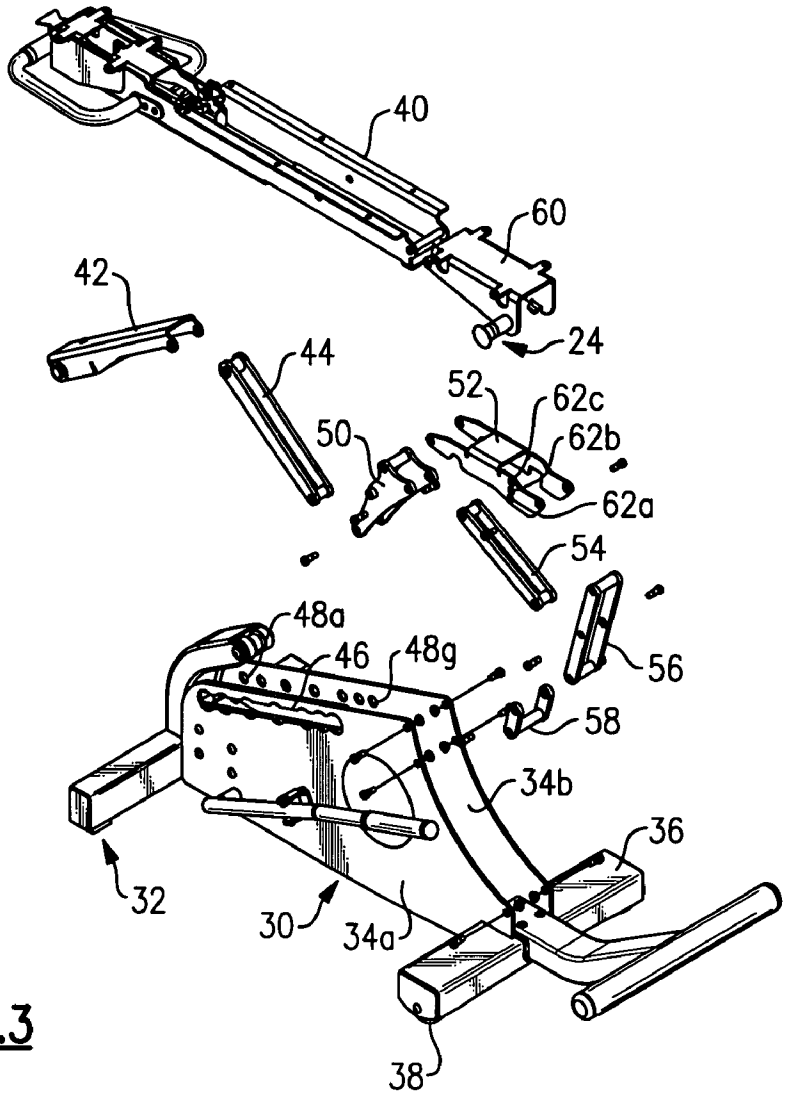
FIG. 3 is an exploded view of the weight bench system illustrating the backrest assembly linkage and the seat assembly linkage.
Figure 3:
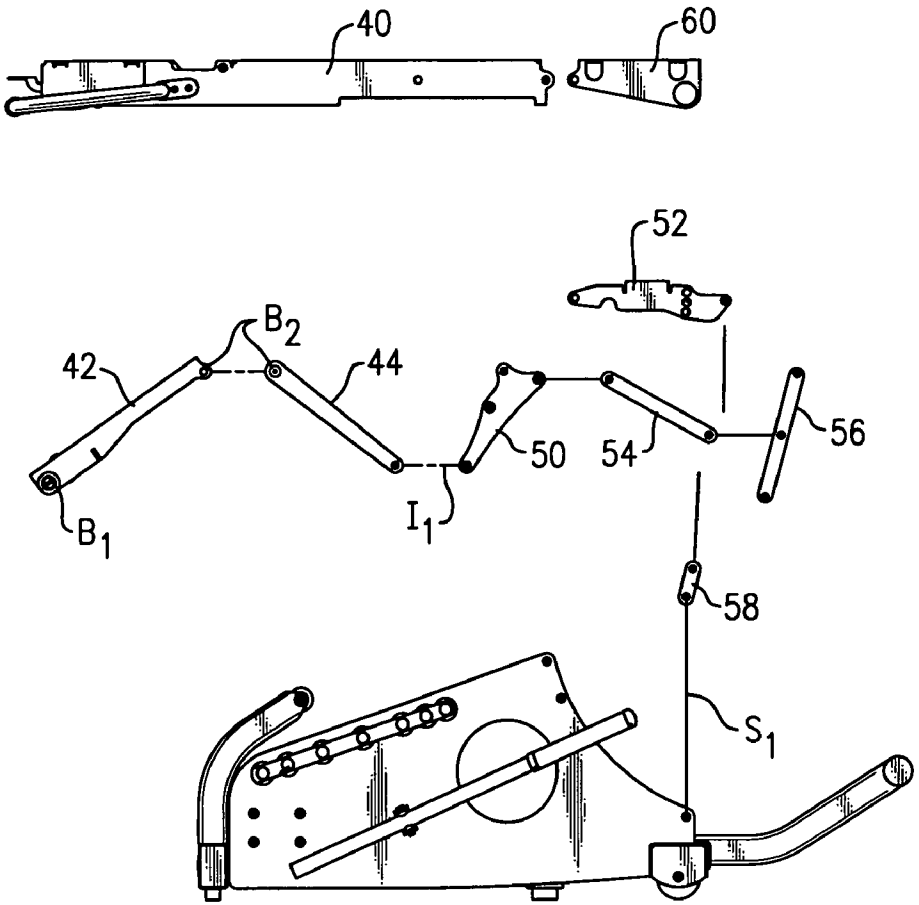

Referring to FIG. 3, the backrest assembly 14 supports the head rest assembly 16. The backrest assembly 14 further includes a backrest cushion frame 40, a rear backrest link 42 and a forward backrest link 44. The rear backrest link 42 is pivotally mounted within the frame assembly 18 between the frame plates 34*a*, 34*b* at a backrest pivot axis B1 (FIG. 4) defined by the seat adjustment pin assembly 26. The rear backrest link 42 receives the seat adjustment pin assembly 26 for movement within an adjustment slot 46 in the first frame plate 34*a* for engagement with a multiple of adjustment apertures 48A-48G in the second frame plate 34*b* as will be further described.

An opposite end segment of the rear backrest link 42 is pivotally attached to the forward backrest link 44 at a backrest pivot axis B2 (FIG. 4) which may be defined by a fastener, pivot pin or the like. It should be understood that various axles or pivot pin arrangements which attach the two components together while providing pivotal movement about the axis may also be utilized with the present invention.

The forward backrest link 44 is pivotally mounted to an intermediate link 50 at an intermediate pivot axis I1 which may be defined by a fastener, pivot pin or the like. The intermediate link 50 is the interface between the backrest assembly 14 and the seat assembly 12.

Figure 4:
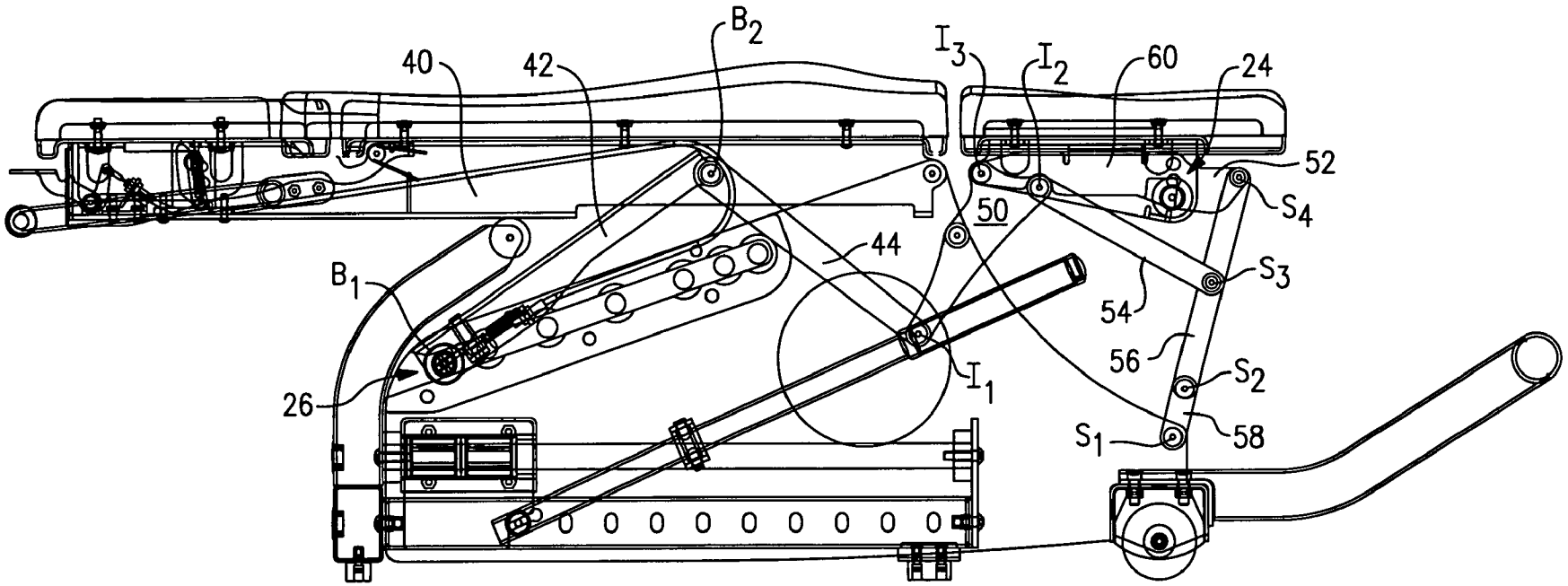
FIG. 4 is a side view of the weight bench system illustrating the pivot axes of the linkages illustrated in FIG. 3.
Figure 5A:
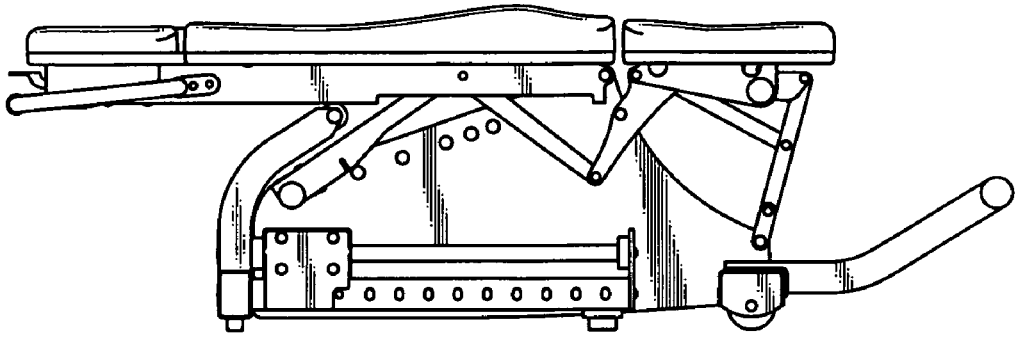
FIGS. 5A-5G show the weight bench system with the backrest in various articulated positions.
Figure 5B:
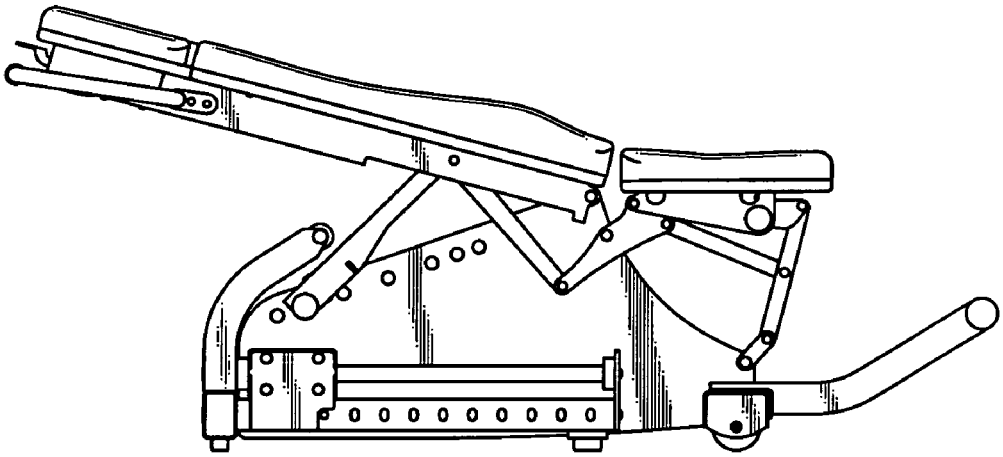
Figure 5C:
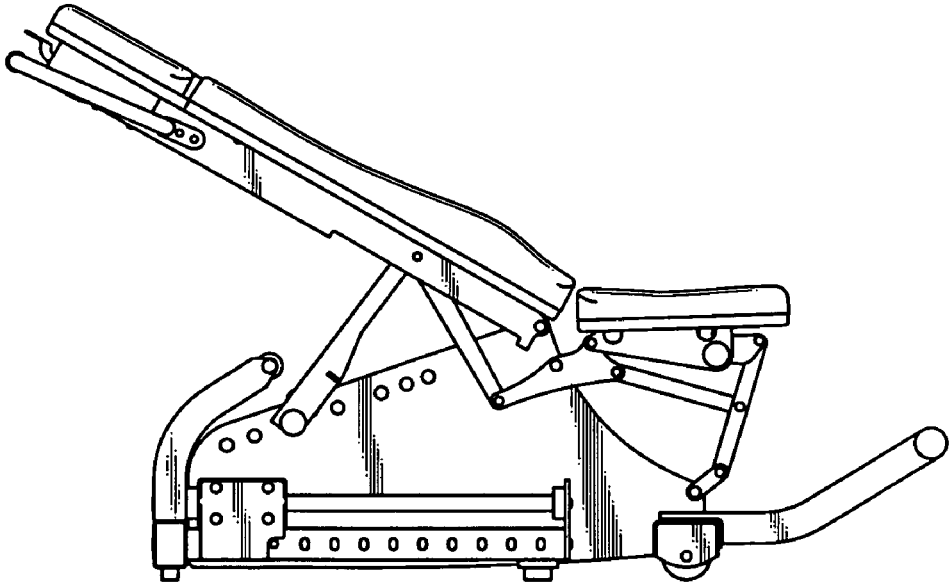
Figure 5D:
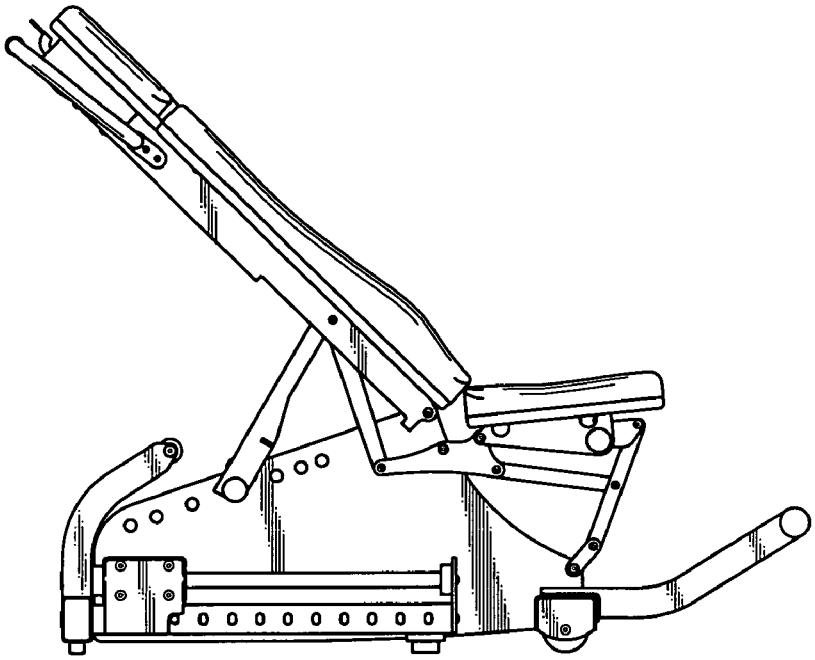
Figure 5E:
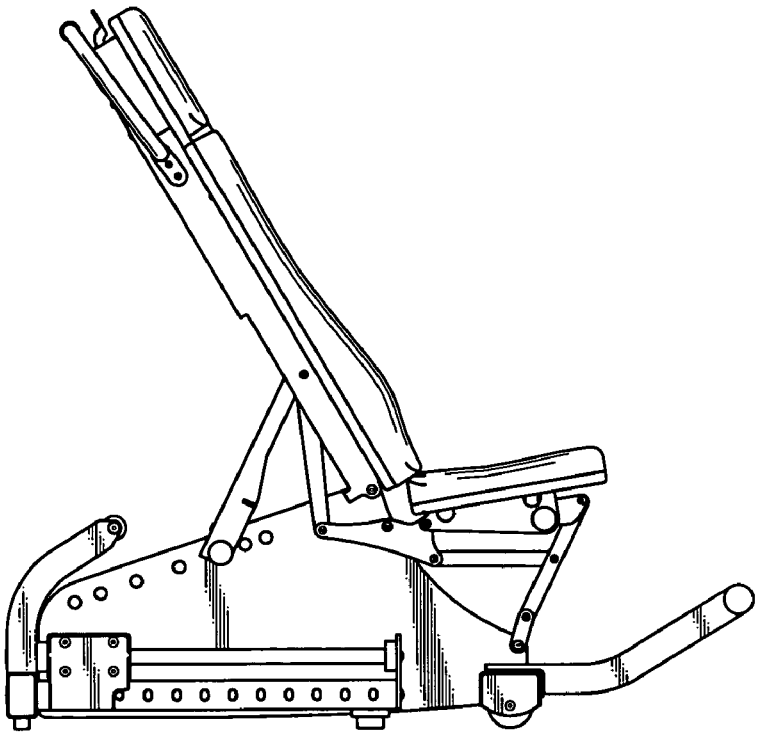
Figure 5F:
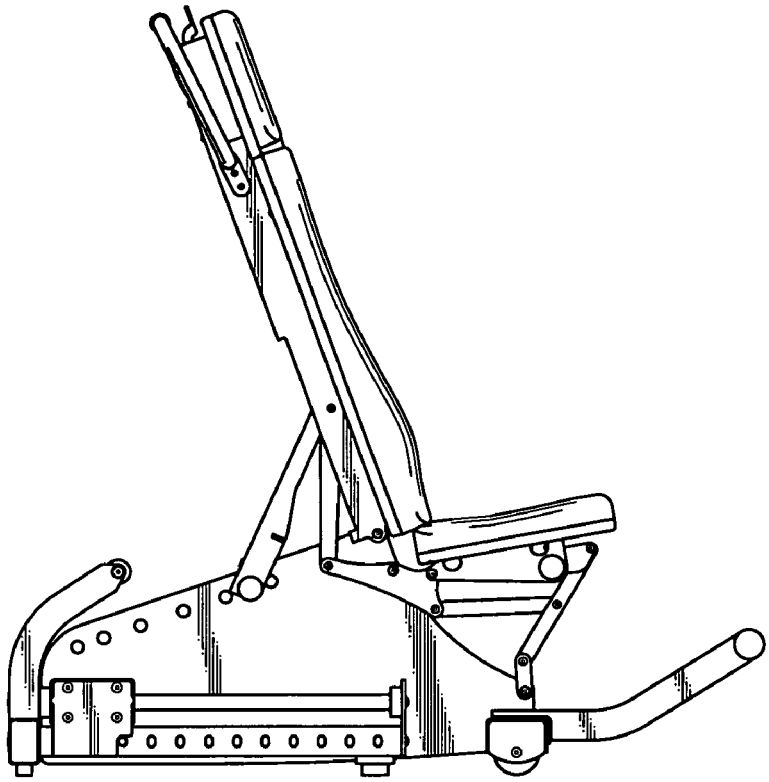
Figure 5G:
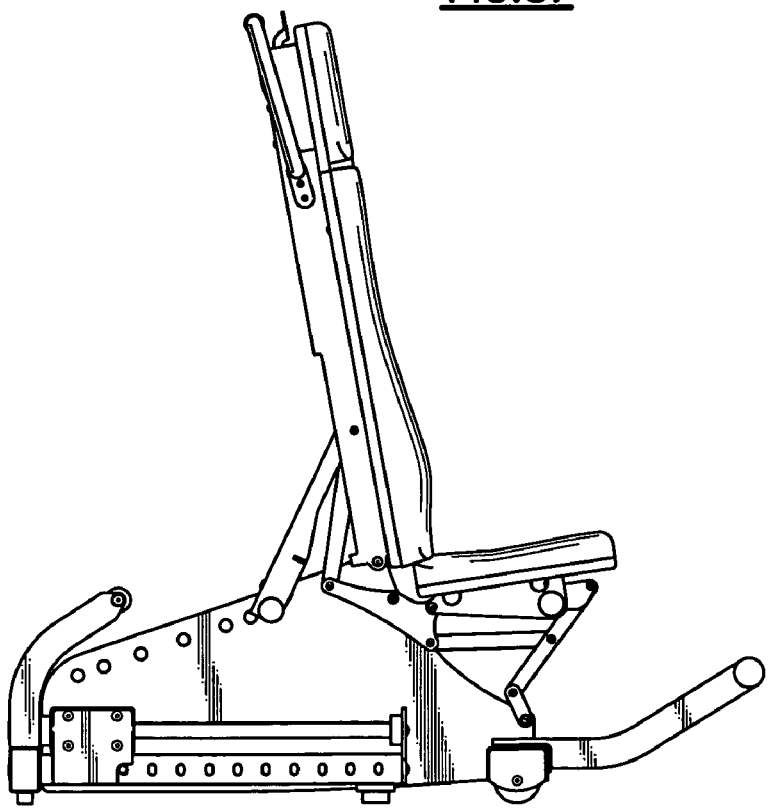

The seat assembly 12 includes a seat cushion frame support link 52, a seat link 54, an intermediate seat link 56 and a forward seat link 58 and a seat cushion frame 60. The forward seat link 58 is mounted within the frame assembly 18 between the frame plates 34*a*, 34*b* at a seat pivot axis S1 which may be defined by a fastener, pivot pin or the like. The forward seat link 58 is pivotally mounted to the intermediate seat link 56 at a seat pivot axis S2 (FIG. 4). The intermediate seat link 56 is pivotally mounted to the seat link 54 at a seat pivot axis S3 and the seat cushion frame support link 52 at a seat pivot axis S4 (FIG. 4). That is, the seat axes S2, S3, S4 are defined by the intermediate seat link 56 with the seat pivot axis S3 intermediate the seat pivot axes S2, S4. The seat link 54 is pivotally mounted to the intermediate link 50 at an intermediate pivot axis 12 which may be defined by a fastener, pivot pin or the like.

The seat cushion frame support link 52 is also pivotally mounted to the intermediate link 50 at an intermediate pivot axis I3 (FIG. 4) which may be defined by a fastener, pivot pin or the like. A seat cushion frame 60 is pivotally mounted to the seat cushion frame support link 52 at the intermediate pivot axis I3 such that the seat cushion frame 60 may be adjusted relative the seat cushion frame support link 52.

The seat cushion frame 60 may be adjusted relative the seat cushion frame support link 52 and locked into place by the seat adjustment pin assembly 24. The seat cushion 60 may be adjusted by selectively engaging the seat adjustment pin assembly 24 into one of a multitude of apertures 62*a*-62*c* defined within the seat cushion frame. Preferably, the seat cushion frame 60 may be adjusted in five (5) degree increments to a plus five and plus ten degree position relative the seat cushion frame support link 52, however, any number of adjustments at various increments may also be utilized with the present invention.

The adjustable seat assembly 12 and the adjustable backrest assembly 14 provide synchronized movement as illustrated in FIGS. 5A-5G. There are seven different back angle positions (0 degrees, 15, 30, 45, 60, 70, and 80) each associated with a position of the backrest adjustment pin assembly 26 which moves within the adjustment slot 46 in the first frame plate 34*a* for engagement with the multiple of adjustment apertures 48A-48G in the second frame plate 34*b*. It should be understood that each aperture 48A-48G is associated with a position of the backrest position (FIGS. 5A-5G). It should be understood that any number or positions may also be utilized with the present invention.

A unique feature of the adjustable seat assembly 12 and the adjustable backrest assembly 14 linkage is that the seat cushion frame 60 remains in a comfortable position relative to the backrest cushion frame 40 in all back angle positions. In other words, the angle between the seat assembly 12 and the backrest assembly 14 is reduced at a slower rate. For example, when the backrest cushion frame 40 of the backrest assembly 14 is at 80 degrees (FIG. 5G), the angle between the seat cushion frame 60 and backrest cushion is 91 degrees. As the forward seat link 58 is pivotally mounted to the intermediate seat link 56 at the seat pivot axis S2, the seat pivot axis S2 transits first forward (FIGS. 5A-5C) until approximately the thirty degree position (FIG. 5C) then reverse aft toward the seat cushion frame for the remainder of the backrest cushion frame 40 movement (FIGS. 5C-5G). Such movement thereby maintains the advantageous relationship.

Figure 6A:
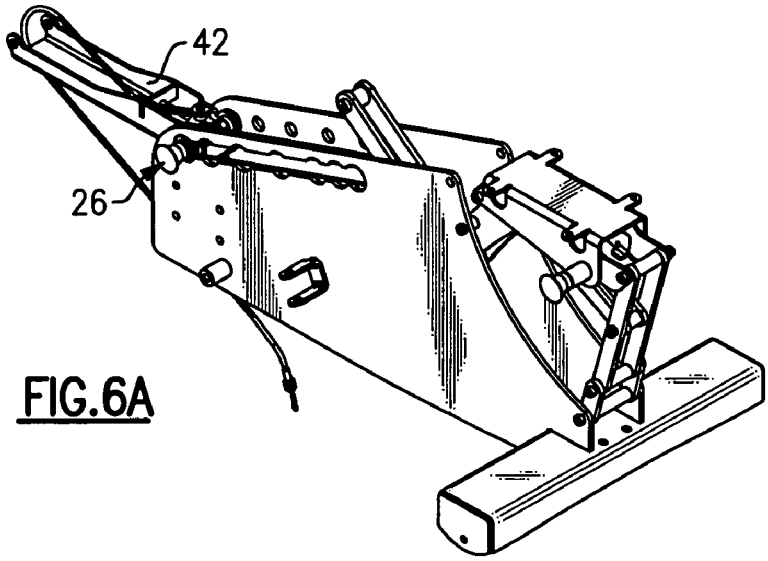
FIG. 6A is a perspective view of the weight bench system with the backrest assembly removed and the rear backrest link articulated to show the backrest adjustment pin assembly.
Figure 6C:
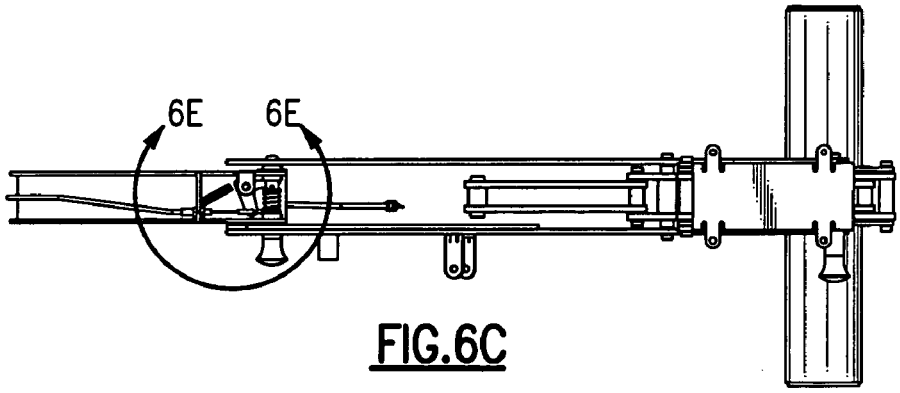
FIG. 6C is a top view of the weight bench as illustrated in FIG. 6A.
Figure 6B:
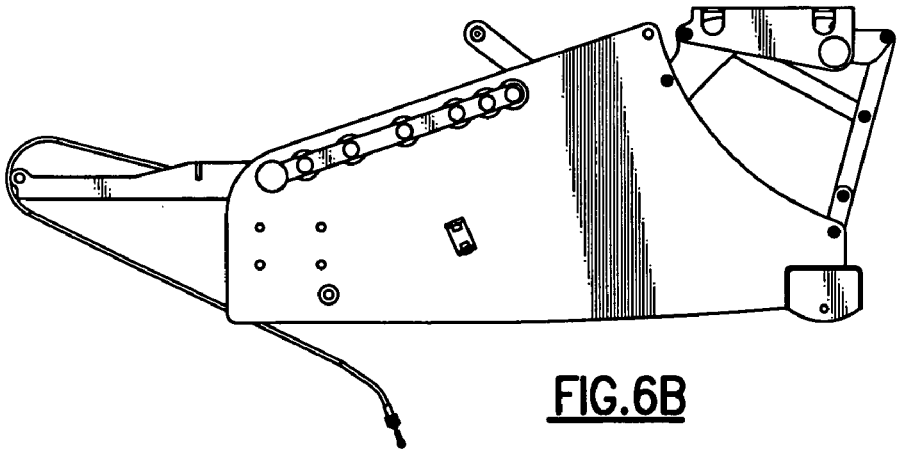
FIG. 6B is a side view of the weight bench as illustrated in FIG. 6A.

Referring to FIGS. 6A-6C, the backrest adjustment pin assembly 26 provides for the significant adjustment of the weight bench system 10. The backrest adjustment pin assembly 26 is located within the rear backrest link 42 to engage the frame plates 34*a*, 34*b* and define the pivot axis B1. In FIGS. 6A-6C, the rear backrest link 42 has been articulated only to better illustrate the location of the backrest adjustment pin assembly 26.

Figure 6D:
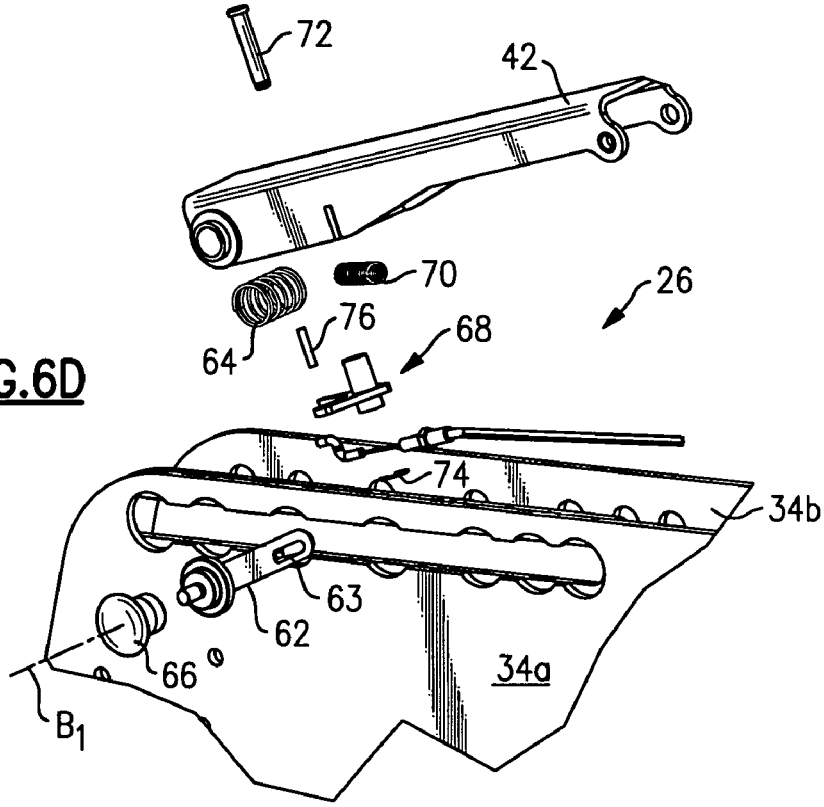
FIG. 6D is an exploded view of the backrest adjustment pin assembly.
Figure 6E:
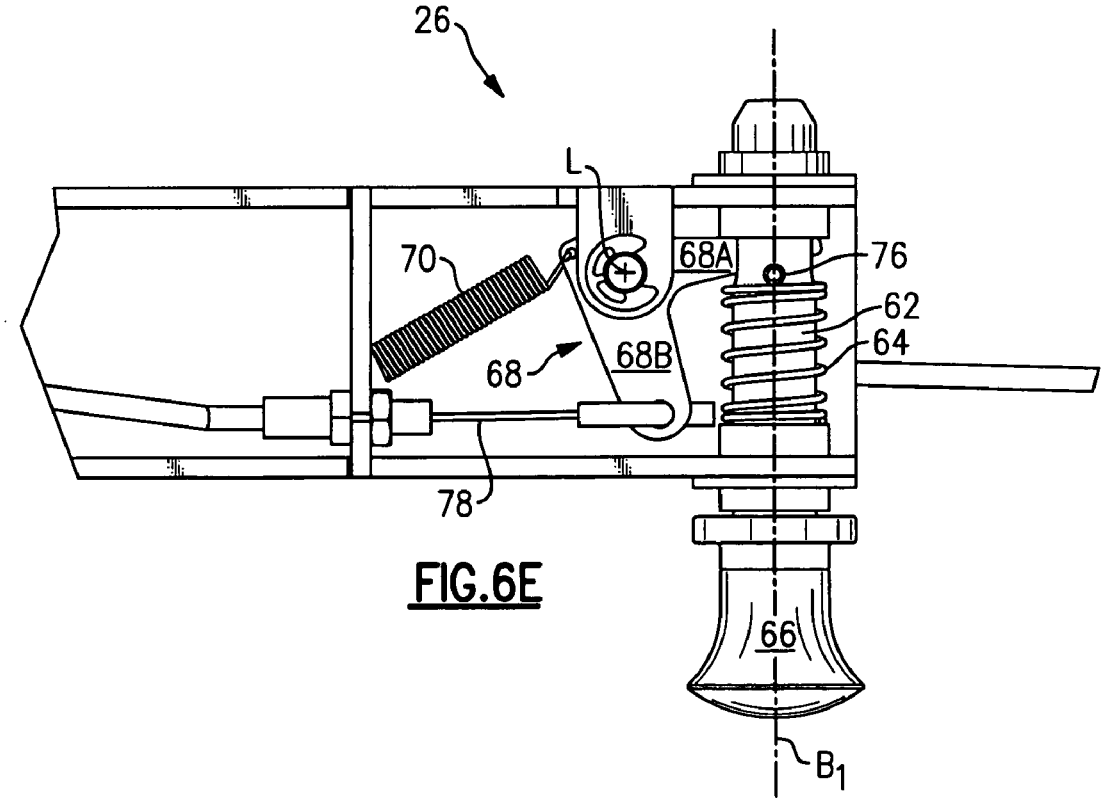
FIG. 6E is an expanded top view of the backrest adjustment pin assembly shown from FIG. 6C.

Referring to FIG. 6D, the backrest adjustment pin assembly 26 generally includes a lock pin 62 defined along the axis of rotation B1. The lock pin 62 includes a longitudinal slot 63 and a knob 66. A lever 68 biased by a spring 70 is mounted (FIG. 6E) to pivot about a lever axis L (FIG. 8) transverse to the axis of rotation B1. The lever 68 is preferably retained by a pin 72 and clip 74 (FIG. 8). The lock pin 62 is biased by a lock pin spring 64 which is axially retained so as not to interfere with the lever 68 by a roll pin 76.

Figure 7:
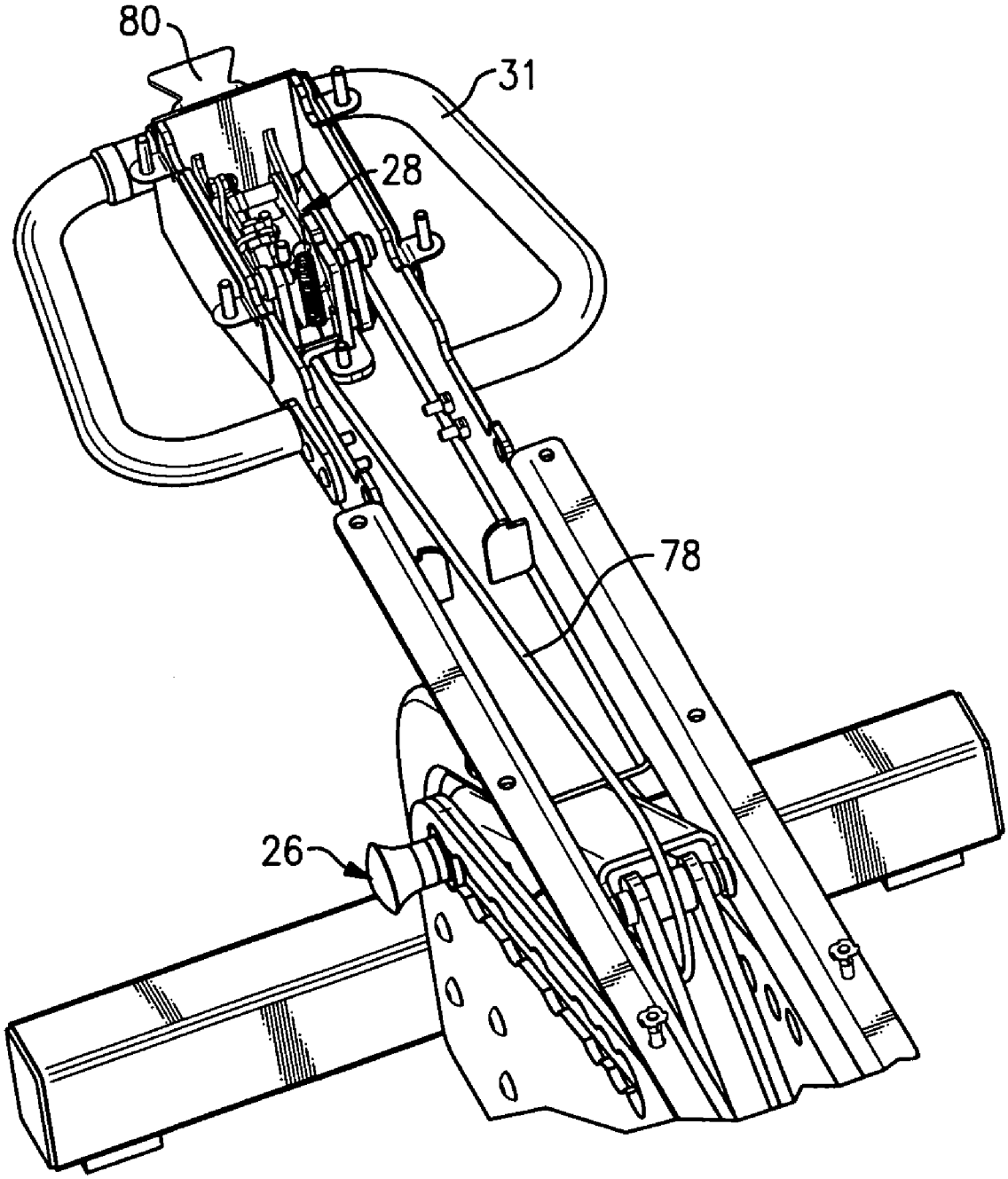
FIG. 7 is a perspective expanded view of the backrest assembly showing the cable attachment between the backrest adjustment pin assembly with the remote handle assembly.

The lever 68 includes a first arm 68A which engages the longitudinal slot 63 within the lock pin 62 and a second arm 68B which is affixed to a cable 78 of the remote handle assembly 28. In operation, the backrest adjustment pin assembly 26 may operated either by directly retracting the lock pin 62 by pulling upon the knob 66 or may preferably be operated remotely by actuating the remote handle assembly 28. The cable 78 is communicated around the rear backrest link 42 and up along the backrest cushion frame 40 where is attached to the remote handle assembly 28 (FIG. 7).

Figure 8B:
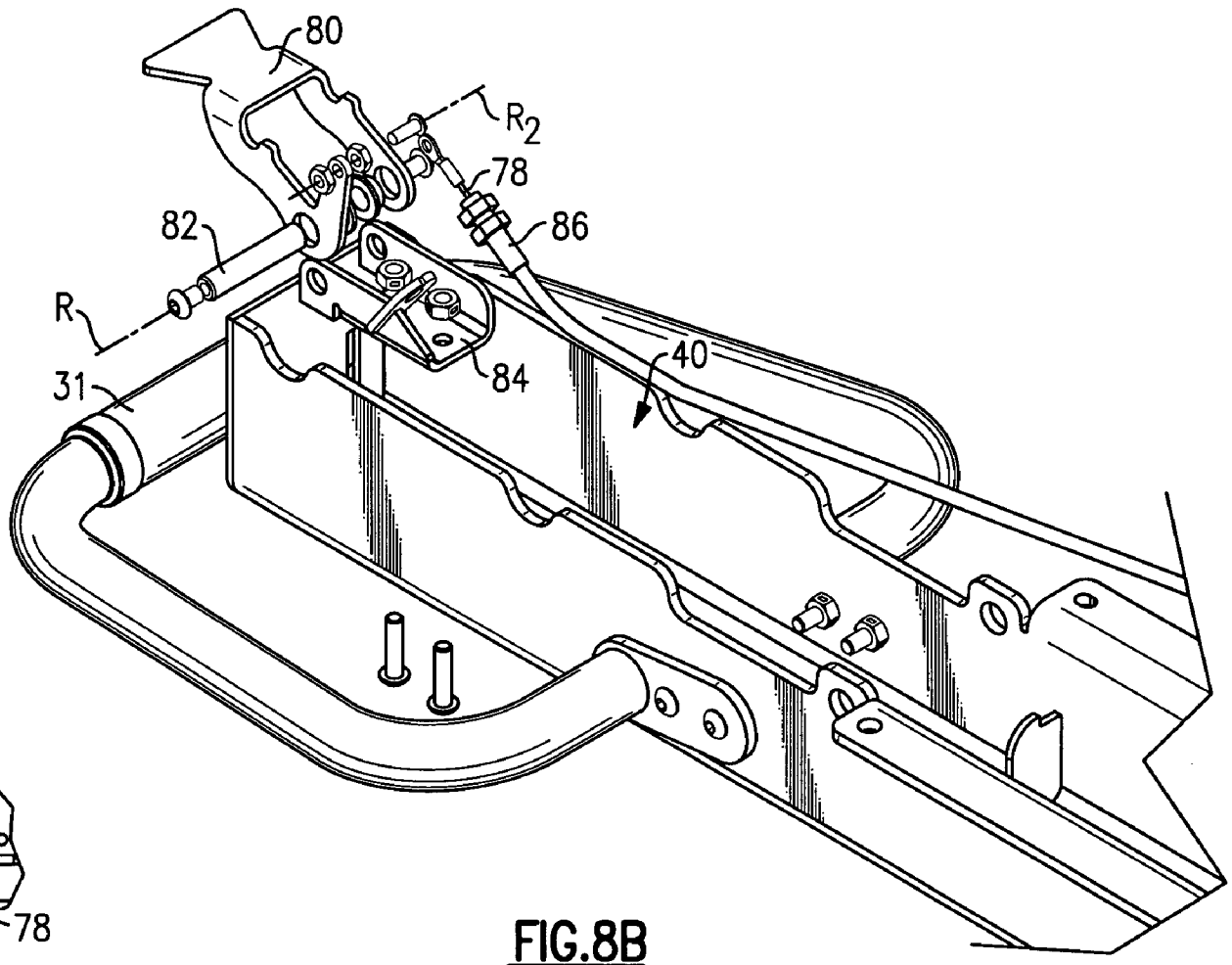
FIG. 8B is an exploded view of the remote handle assembly.
Figure 8A:
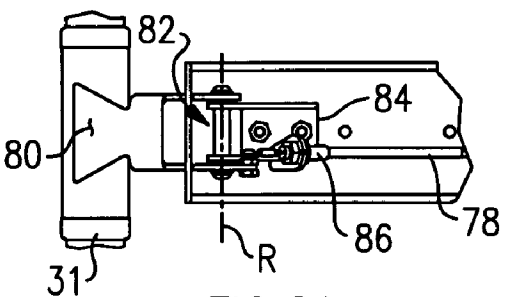
FIG. 8A is an expanded top view of the remote handle assembly.

Referring to FIG. 8A, the remote handle assembly 28 includes a handle 80 which is mounted to pivot about a pivot axis R defined by a pivot pin 82 (FIG. 8B; exploded view). The pivot pin 82 is retained by a bracket 84 which also retains a cable sleeve 86 of the cable 78. In operation, the operator presses on the handle 80 toward the fixed handle bar 31 such that the cable 78 is pulled by the handle 80 as it pivots about the axis R to pull the lock pin 62 out of engagement with the frame plate 34*a* and 34*b*. The spring 70 which biases the lever 68 (FIG. 6E) operates to bias the handle 80 such that pressing on the handle overcomes the bias of spring 70. Notably, the lever 68 drives the lock pin 62 when the remote handle assembly 28 is actuated but the lever 68 may be essentially stationary relative to the lock pin 62 when the knob 66 is pulled directly as the lever arm 68 just moves within the slot 63 (FIG. 6D).

Figure 9A:
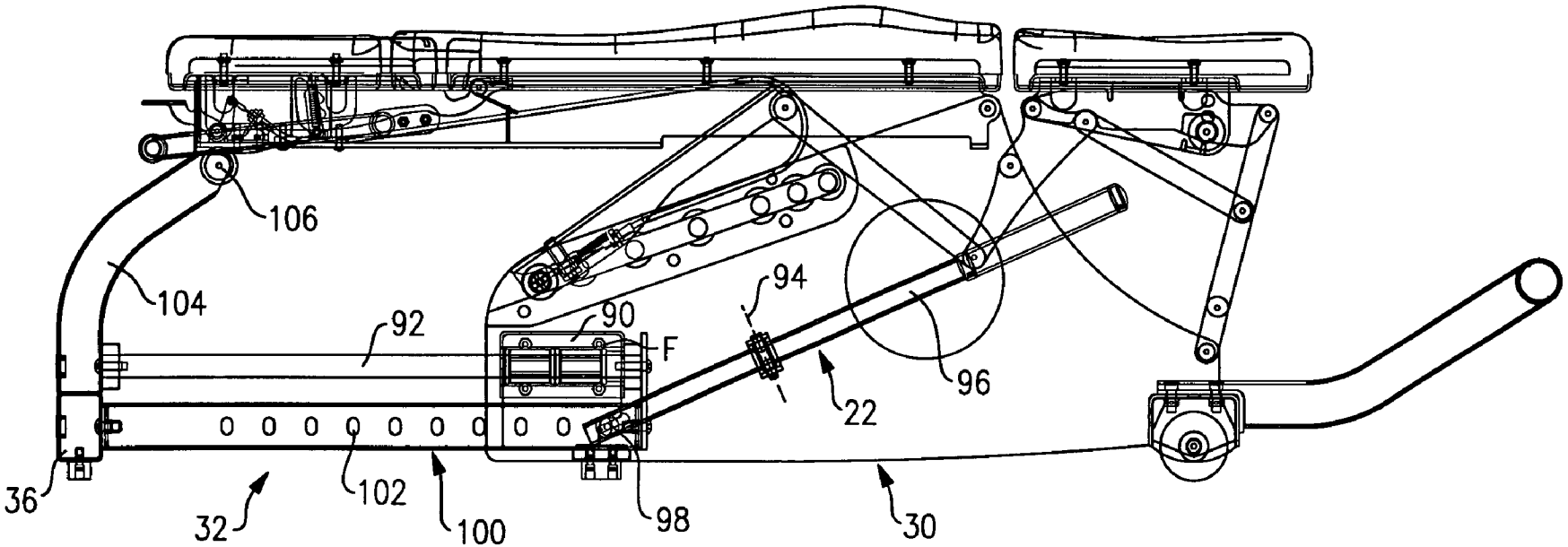
FIG. 9A is a side view of the weight bench system in a fully extended position.
Figure 9B:
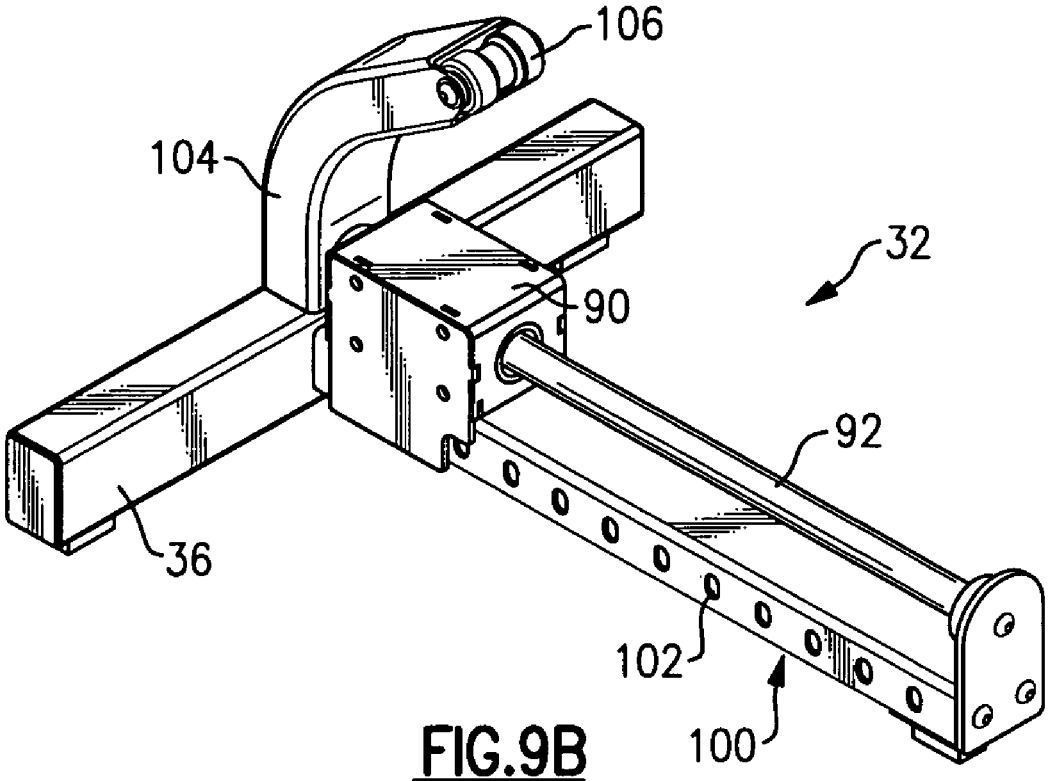
FIG. 9B is a perspective view of the rear leg assembly illustrated in FIG. 9A.
Figure 9C:
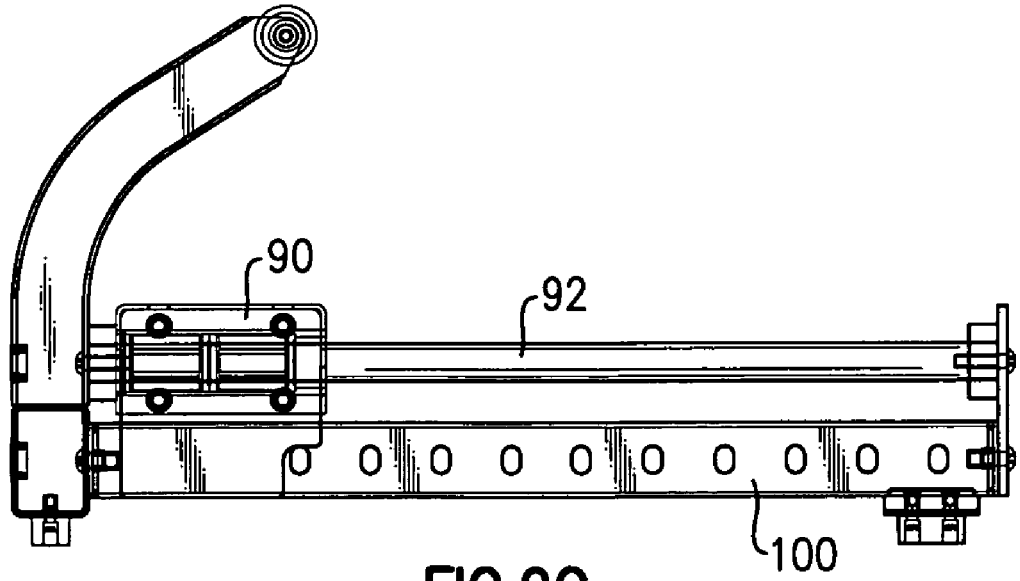
FIG. 9C is a side view of the rear leg assembly shown in FIG. 9A.

Referring to FIG. 9A, the rear leg assembly 32 is selectively movable in a fore/aft direction relative the base assembly 30. The rear leg assembly 32 (also illustrated in FIGS. 9B and 9C) includes a slide 90 which is movable along a rod 92. The slide 90 is attached to the base assembly 30 between the frame plates 34*a*, 34*b* through fasteners f such as bolts or the like. The fore/aft lever assembly 22 is mounted to the frame plate 34*a* to pivot about a pivot 94 transverse to the lever 96 to selectively retract a lock pin 98 from a longitudinal base member 100 of the rear leg assembly 32. The longitudinal base member 100 includes a multitude of apertures 102 to selectively receive the lock pin 98 and adjust the fore/aft distance between the base assembly 30 and the transverse leg 36 of the rear leg assembly 32.

The rear leg assembly 32 preferably includes an upright 104 with a roller 106 which supports the backrest assembly 14 as the base assembly 30 is transited relative the rear leg assembly 32.

It should be understood that relative positional terms such as "forward," "aft," "upper," "lower," "above," "below," and the like are with reference to the normal operational attitude and should not be considered otherwise limiting.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A weight bench system comprising:

a seat assembly;

a backrest assembly, said backrest assembly includes a rear backrest link pivotally attached to a forward backrest link at a backrest pivot axis, said forward backrest link pivotally attached to an intermediate link at an intermediate pivot axis, said intermediate link attached between said seat assembly and said backrest assembly; and a backrest adjustment pin assembly engaged with sad rear backrest link, said backrest adjustment pin assembly includes a lock pin engaged with a lever, said lock pin axial movable along an axis transverse to an axis about which said lever pivots.

2. The system as recited in claim 1, further comprising a frame assembly, said rear backrest link pivotally attached to said frame assembly at a rear pivot axis, said intermediate link pivotally attached to said frame assembly.

3. The system as recited in claim 1, wherein said lock pin includes a longitudinal slot within which an arm of said lever is received.

4. The system as recited in claim 3, wherein said lock pin is spring biased.

5. The system as recited in claim 3, wherein said lever is spring biased.

6. The system as recited in claim 1, further comprising a remote handle assembly connected to said lever.

7. The system as recited in claim 6, further comprising a cable which connects said remote handle assembly to said lever.

8. The system as recited in claim 6, wherein said remote handle assembly is mounted to said backrest assembly.

9. The system as recited in claim 1, wherein said seat assembly includes a seat cushion frame support link pivotally mounted to said intermediate link.

10. The system as recited in claim 9, further comprising a seat cushion frame pivotally mounted to said seat cushion frame support link.

11. The system as recited in claim 10, further comprising a seat adjustment pin assembly mounted to said seat cushion frame, said seat adjustment pin assembly selectively engageable with one of a multiple of apertures within said seat cushion frame support link.

12. A weight bench system comprising:

a seat assembly;

a backrest assembly;

an intermediate link attached between said seat assembly and said backrest assembly;

a forward seat link;

an intermediate seat link pivotally mounted to said forward seat link; and a seat link pivotally mounted to said intermediate seat link and pivotally mounted to said intermediate link.

13. The system as recited in claim 12, further comprising a frame assembly, said forward seat link pivotally mounted to said frame assembly.

14. The system as recited in claim 12, further comprising a seat cushion frame support link pivotally mounted to said intermediate link and pivotally mounted to said intermediate seat link.

15. The system as recited in claim 14, further comprising a seat cushion frame pivotally mounted to said seat cushion frame support link at an axis common to said intermediate seat link.

16. A weight bench system comprising:

a seat assembly;

a backrest assembly including a rear backrest link pivotally attached to a forward backrest link;

a backrest adjustment pin assembly engaged with said rear backrest link;

a remote handle assembly connected to said backrest adjustment pin assembly; and an intermediate link attached between said seat assembly and said forward backrest link.

17. The system as recited in claim 16, further comprising a seat adjustment pin assembly mounted to said seat assembly, said seat adjustment pin assembly selectively engageable with one of a multiple of apertures to select an angle between a seat cushion frame support link and a seat cushion frame.

18. A method of positioning a weight bench seat assembly relative a backrest assembly comprising the steps of:

articulating a backrest assembly;

articulating a seat assembly in response to articulating the backrest assembly, the seat assembly defining seat pivot axis which transits both forward an aft in response to a unidirectional articulation of the backrest assembly through a range of motion; and transiting the seat pivot axis forward until the backrest assembly obtains an approximately thirty degree position then the seat pivot axis reverses and traverses aft in response to the backrest assembly increasing beyond the approximately thirty degree position.

19. A method of positioning a weight bench seat assembly relative a backrest assembly comprising the steps of:

articulating a backrest assembly;

articulating a seat assembly in response to said step (A), the seat assembly defining a seat pivot axis which transits both forward and aft in response to a undirectional articulation of the backrest assembly through a range of motion; and transiting the seat pivot axis aft until the backrest assembly obtains an approximately thirty degree position then the seat pivot axis reverses and traverses forward in response to the backrest assembly continuing toward a zero degree position.

* * * * *

UNITED STATES PATENT AND TRADEMARK OFFICE

CERTIFICATE OF CORRECTION

PATENT NO. : 7,465,260 B2
APPLICATION NO. : 11/326059
DATED : December 16, 2008
INVENTOR(S) : Hockemeyer It is certified that error appears in the above-identified patent and that said Letters Patent is hereby corrected as shown below:

Claim 1, Column 5, line 31: "sad" should read as --said--

Claim 18, Column 6, line 41: insert --a-- between "defining" and second occurrence of "seat"

Claim 19, Column 55: "undirectional" should read as --unidirectional--

Signed and Sealed this

Twenty-sixth Day of May, 2009

John Doll

JOHN DOLL
*Acting Director of the United States Patent and Trademark Office*